US006004247A

United States Patent [19]

Webber

[11] Patent Number: 6,004,247

[45] Date of Patent: Dec. 21, 1999

[54] EXERCISE APPARATUS WITH MULTI-EXERCISE PRESS STATION

[76] Inventor: Randall T. Webber, 11162 Morning Creek Dr., San Diego, Calif. 92128

[21] Appl. No.: 08/886,259

[22] Filed: Jul. 1, 1997

Related U.S. Application Data

[63] Continuation-in-part of application No. 08/374,243, Jan. 18, 1995, Pat. No. 5,683,334.

[51] Int. Cl.[6] ..... A63B 23/12

[52] U.S. Cl. ..... 482/100; 482/136; 482/137; 482/139

[58] Field of Search ..... 482/72, 73, 94–97, 482/100, 112, 113, 129, 130, 136–139

[56] References Cited

U.S. PATENT DOCUMENTS

| | | | |
|---|---|---|---|
| 4,563,003 | 1/1986 | Bugallo et al. . | |
| 4,793,608 | 12/1988 | Mahnke et al. . | |
| 4,949,951 | 8/1990 | Deola . | |
| 4,986,538 | 1/1991 | Ish, III | 482/100 |
| 5,356,353 | 10/1994 | Takaoka . | |
| 5,370,595 | 12/1994 | Voris et al. . | |
| 5,387,171 | 2/1995 | Casey et al. . | |
| 5,409,440 | 4/1995 | Yang . | |
| 5,417,633 | 5/1995 | Habing . | |
| 5,580,341 | 12/1996 | Simonson . | |
| 5,597,375 | 1/1997 | Simonson . | |
| 5,605,523 | 2/1997 | Ish, III et al. . | |
| 5,620,402 | 4/1997 | Simonson . | |
| 5,733,229 | 3/1998 | Dalebout et al. | 482/96 |

FOREIGN PATENT DOCUMENTS 1257091 2/1960 France .

OTHER PUBLICATIONS

Hoist Dual 300 Assembly Instructions, Jul. 1996.
Studio 6. Deluxe Home Gym. Brochure. BFCO, Apr. 1995.
Weslo. Body Focus. Brochure Mar. 1994.
Weslo. Body Focus. Owner's Manual (Revised) © 1994.
"CYBEX Strength Systems" catalog, CYBEX, 1995.
Hoist Fitness Systems, 880 Multi–Function Home Gym, first distributed Feb. 1994.
Tuff Stuff (advertisement), Jan. 1997.
"Swivel Grip" (advertisement), received in PTO Jun. 9, 1994.

*Primary Examiner*—John Mulcahy
*Attorney, Agent, or Firm*—Brown, Martin, Haller & McClain, LLP

[57] ABSTRACT

An exercise apparatus has a support frame and a press arm assembly rotatably mounted on the support frame. The press arm assembly includes a yoke with opposite side portions and first and second elongate swing arms each linked to the first and second side portions of the yoke, respectively. Each swing arm has at least one handle at one end for selective gripping by a user to perform different exercises. A three-dimensional pivot assembly links each swing arm to the respective yoke side portion to permit the swing arm to rotate in and out, up and down, and to pivot about its own axis to vary the handle orientation, so that the user can readily select any desired orientation of the swing arm and handle for performing press and fly exercises.

14 Claims, 8 Drawing Sheets

EXERCISE APPARATUS WITH MULTI-EXERCISE PRESS STATION

CROSS-REFERENCES TO RELATED APPLICATIONS

This application is a Continuation-In-Part of Application Ser. No. 08/374,243 filed on Jan. 18, 1995, now U.S. Pat. No. 5,683,334.

BACKGROUND OF THE INVENTION

The present invention relates generally to exercise apparatus in which multiple exercise stations are provided for operation in opposition to a weight stack or load to exercise different muscles or muscle groups, and is particularly concerned with exercise apparatus having a press station for performing press type exercises for exercising the chest muscles.

Typically, exercise apparatus of this type is known as a weight machine and includes a support frame on which a weight stack is slidably mounted and linked to various exercise stations via a linkage system such as a cable and pulley mechanism so that the user can lift the weights using different muscle groups depending on the exercise station used. Such machines often incorporate a press station at which a user can perform bench press type exercises by pushing outwardly directly away from the chest against the load in the weight stack. Press stations typically comprise a swing frame pivoted to the support frame for movement in opposition to the weight stack, with a pair of handles for gripping by the user and pushing away from the body to move the swing frame. However, this limits the type of press exercises which can be performed.

In U.S. Pat. No. 4,986,538 of Ish III, a multi-exercise press station is described in which a floating swing frame is used to allow decline, incline, chest and shoulder presses to be performed. The U-shaped, floating swing frame has handles at its ends and is pivoted at a floating pivot to a swing link which is in turn pivoted to the support frame. The swing frame is linked to the weight stack for resisting swinging movement of the swing frame.

U.S. Pat. No. 4,949,951 of Deola describes a press-type exercise machine in which a U-shaped member is pivotally connected to the frame in an overhead position and has its lower ends linked to the weight stack. Two bar members are each connected at one end to a respective end of the U-shaped member via a universal joint connection, and each bar has a gripping member at its free end.

SUMMARY OF THE INVENTION

It is an object of the present invention to provide an exercise apparatus having a press station providing multiple exercise functions.

According to the present invention, an exercise apparatus is provided which comprises a support frame having an upper portion, a base portion, a forward end, a rear end, and opposite sides, a yoke assembly pivotally linked to the support frame for swinging movement about a first pivot axis, the yoke assembly having first and second side portions, first and second elongate swing arms each having a longitudinal axis and being linked to the first and second side portions of the yoke assembly, respectively, each swing arm having at least one handle at one end for selective gripping by a user to perform different exercises, and first and second articulating joints for linking the first and second swing arm, respectively, to the respective first and second yoke side portions, each joint having a first pivot connection for allowing movement of the respective arm in a circular path about a first axis perpendicular to the longitudinal axis of the arm, and a second pivot connection for allowing movement of said arm about a second axis perpendicular to the first axis and the arm axis. Each swing arm preferably also has a rotatable coupling for allowing rotation of the handle about the longitudinal axis of the swing arm to adjust the orientation of the handle.

With this arrangement, the swing arms can be adjusted in and out about the first axis, and up and down about the second axis, into a desired position for performing exercises by moving the yoke about the first pivot axis, so that different muscle groups can be readily exercised. At the same time, each handle is rotatable about the longitudinal axis of the respective swing arm, so that the handle orientation can be adjusted into the most natural or comfortable position for each exercise path, and can even be adjusted during each swing of the arms and yoke assembly. In a preferred embodiment of the invention, rotation of the arm about at least the first axis is limited, for example by a limit slot and pin engagement in the first pivot connection. This limits the amount by which the arms can swing outwardly from the apparatus, to reduce the risk of injury to bystanders or damage due to impact with adjacent equipment if the user lets go of the arms. A suitable rotation limiting device is also preferably provided in the third pivot connection, to reduce the risk of the user injuring their wrist due to over-rotation of the handle, for example. A rotation limiting device may also be provided on the second pivot connection, if desired, although this is not essential.

Thus, the press station of this invention allows a variety of different exercises to be performed conveniently at a single station. The handles can be pushed in any direction to exercise different chest muscle and other muscle regions, and can also be used for pulling in a midrow style exercise. Since the entire handle rotates about the axis of the handle arm, it can be adjusted to follow the natural rotation of a user's arm while performing exercises.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 4:
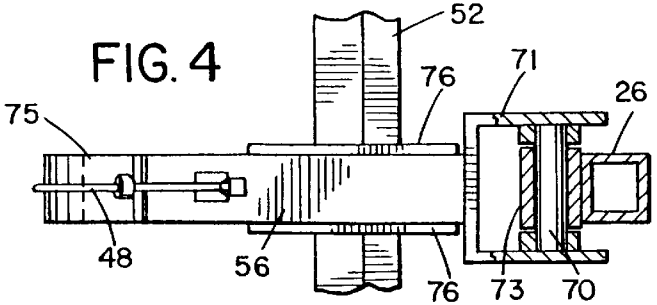
FIG. 4 is an enlarged sectional view taken on line 4—4 of FIG. 1.
Figure 5:
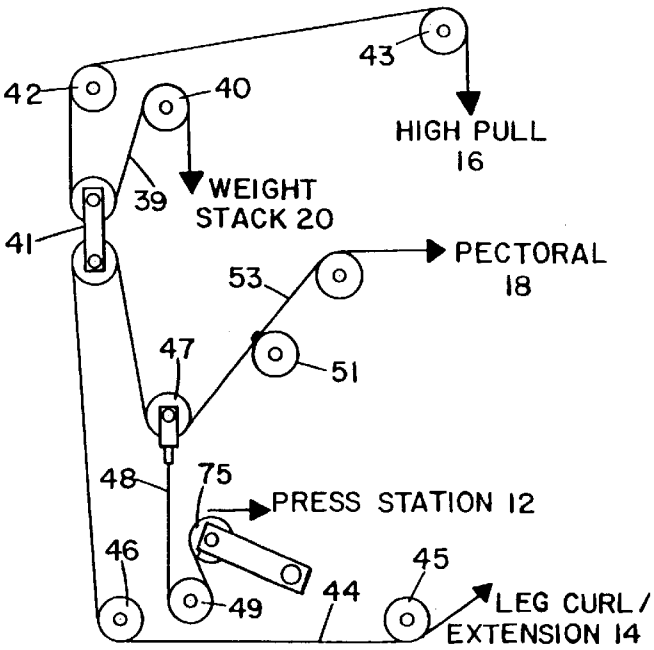
FIG. 5 is a schematic of a cable and pulley system for the exercise machine.

A multi-station exercise apparatus according to a first embodiment of the present invention is illustrated in FIGS. 1–7 of the drawings. The apparatus basically comprises a support frame 10 on which a plurality of exercise stations 12,14 and 16 are mounted and linked to a slidably mounted weight stack 20 via a system of cables and pulleys. The exercise stations include press station 12 which is primarily intended for performing press-type exercises, a leg extension station 14 for performing leg extensions and leg curl exercises, and a high pull station 16 for performing pull-down type exercises. A conventional pectoral station 18 for performing pectoral fly type exercises may also be provided, as schematically illustrated in FIG. 5.

The frame 10 includes base 22, rear upright struts 24 projecting upwardly from the rear end of the base, vertical upright 26 projecting upwardly from an intermediate position on the base, and a top strut 28 projecting transversely across the upper ends of struts 24 and 26. A seat back pad 30 is adjustably mounted on the vertical upright strut 26 via seat adjuster mount 31, and seat bottom pad 32 is adjustably mounted on the base 22 via seat adjuster mount 34. The seat adjuster mount 31 allows the position of pad 30 relative to strut 26 to be adjusted while adjuster mount 34 allows the height of pad 32 to be adjusted. A person sitting on seat pad 32 and resting their back against back pad 30 can perform various exercises using each of the exercise stations, while other exercises can be performed while in a standing position or sitting on pad 32 in a rearward facing position, as will be explained in more detail below.

The weight stack 20 is of standard construction, and comprises a stack of rectangular weights which are slidably mounted on a pair of vertical guide rods 36 extending between the base and top bar of the frame. A conventional adjustment mechanism (not illustrated) is provided for selecting the number of weights in the stack to be lifted. This mechanism includes an adjustment rod extending downwardly through aligned holes in the weights, with each weight having a central horizontal hole registering with a respective hole in the rod. A lock pin is extended through a selected hole into the corresponding hole in the rod to determine how many weights will be lifted. The selected weight and all weights above that weight in the stack will be lifted. The top plate 38 in the stack is linked via a cable and pulley mechanism to the various exercise stations, for example as schematically illustrated in FIG. 5. Although a weight stack is used as the exercise resistance in the illustrated embodiment, it will be understood that other alternative exercise resistance means may be provided in other embodiments of the invention, such as plate loaded devices, shock absorber devices, rubber band resistance devices, or the like.

The weight stack is linked via a suitable cable and pulley mechanism including various cables and fixed and floating pulleys to each of the exercise stations, for example as schematically illustrated in FIG. 5. In the illustrated example, a first cable 39 extends from weight stack 20 over top fixed pulley 40 and around the upper pulley of floating double pulley 41, fixed pulleys 42,43 on top strut 28, and out to the high pull station 16. A second cable 44 extends from leg extension station 14 out around lower fixed pulleys 45,46, around the lower pulley of floating double pulley 41, around floating pulley 47, and stops at pulley 51, where it can be attached to another cable 53 for the pectoral station 18, which will be of standard construction, and is therefore not illustrated in detail. Finally, third cable 48 extends from arm press station 12 around fixed pulley 49 and is secured to floating pulley 47. At each exercise station, a stop is provided on the respective cable to prevent pull back when any of the other stations is in use. Thus, exercises performed at the press station 12 will lift the weight stack 20 via cable 48, floating pulley 47, cable 44, double floating pulley 41, and cable 39.

It will be understood that FIG. 5 is only one example of a possible combined cable and pulley linkage from a weight stack to various exercise stations. In addition to the cable and pulley linkages of FIG. 5, for example, cable 44 may extend over pulley 47 and additional pulleys to an ab crunch station as is known in the field, with one of the pulleys being a double floating pulley to link to a pectoral station. Other alternative cable and pulley linkages may be provided, as is known in the field.

Only a single cable and pulley linkage is illustrated in the remaining drawings between the press station 12 and the weight stack 20, with the cable and pulley linkages between the other exercise stations and weight stack being eliminated for clarity. However, it will be understood that, in practice, multiple cable and pulley mechanisms will be provided, for example as schematically illustrated in FIG. 5, in order to link each exercise station to the weight stack and allow each station to be operated independently of the others. Thus, in FIG. 1, only cable 48 is illustrated, extending from the press station over fixed pulley 49 on the base of the frame, and up over top pulley before connecting to top plate 38 of the weight stack.

Figure 2:
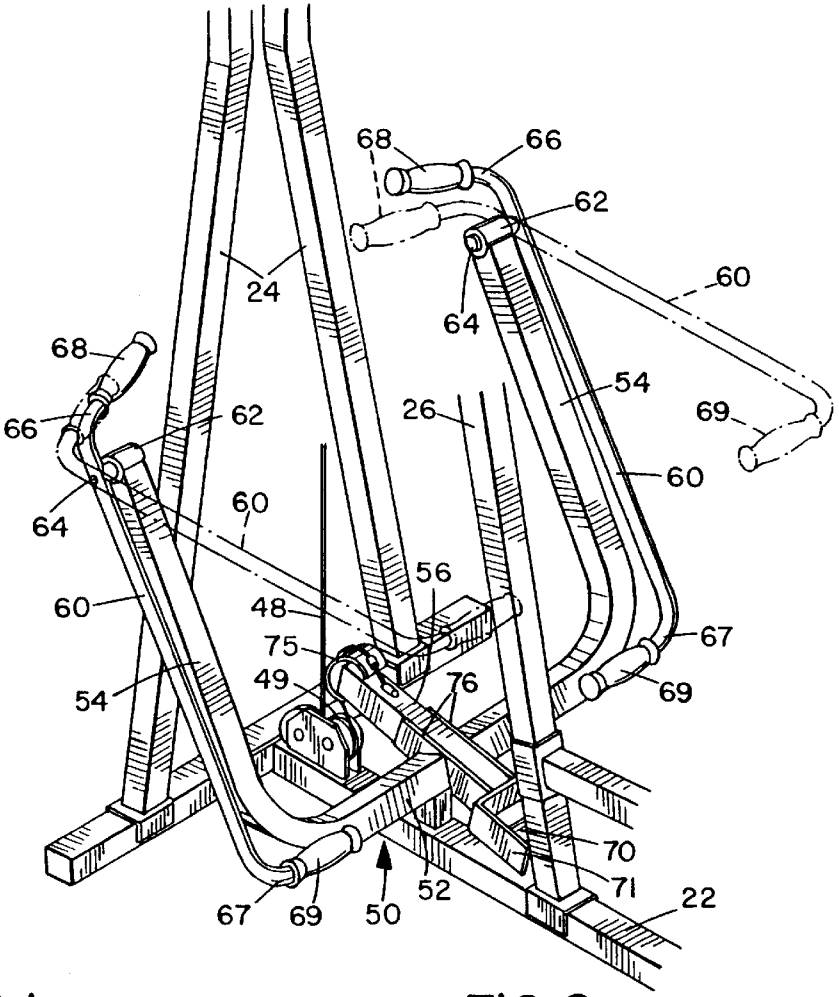
FIG. 2 is an enlarged perspective view of the press arm structure.
Figure 3:
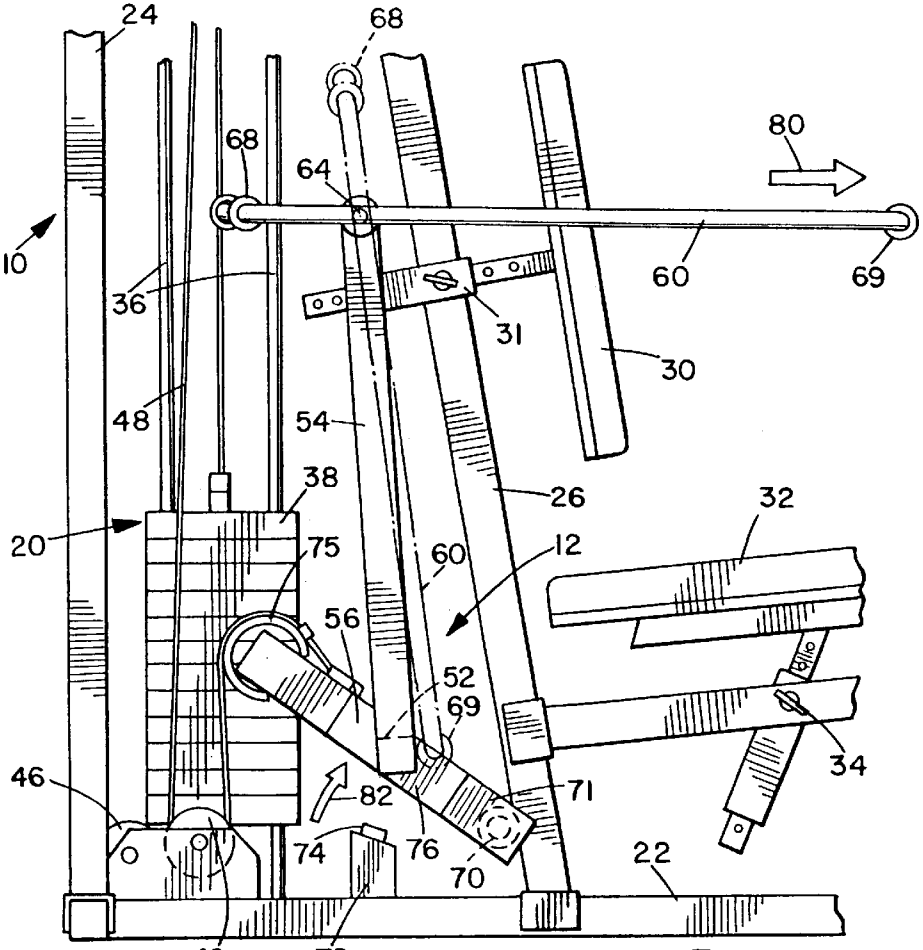
FIG. 3 is an enlarged side elevation view of a lower portion of FIG. 1.

The press station 12 will now be described in more detail with reference to FIGS. 1–4. The station 12 basically comprises a generally U-shaped, split yoke 50 having a central portion 52 and opposite side portions or legs 54, with a lever arm 56 secured to the yoke at an angle to the plane of the yoke, as best illustrated in FIGS. 2 and 3. A pair of swinging handle arms 60 are pivotally secured to the respective ends 62 of the side portions 54 of the yoke via pivot pins 64. Each swing or handle arm 60 has bent portions 66,67 at its opposite ends on which handles or grips 68,69, respectively, are mounted, and is pivotally connected to the respective end 62 of the yoke at a location which is relatively close to handle 68, providing a longer handle arm for handle 69 than handle 68. Each arm 60 is therefore free to pivot about the axis of pivot pin 64 relative to yoke 50. In the rest position illustrated in solid lines in FIGS. 1 and 2, the lower or longer handle arms will pivot downwardly until the inwardly bent handles 69 rest against the central portion 52 of yoke 50, as illustrated in FIG. 2, with the shorter handles 68 uppermost.

The lever arm 56 is pivotally secured at one end to upright strut 26 via press arm pivot shaft 70 at a location adjacent the lower end of the strut, so that the lever arm extends rearwardly from strut 26. As best illustrated in FIG. 4, lever arm 56 has a fork 71 at its end and pivot pin or shaft 70 extends between the opposite limbs of fork 71 and extends rotatably through a mounting tube 73 secured to strut 26. A pulley or cam wheel 75 is secured at the opposite end of the lever arm 56, and the end of press arm cable 48 extends over pulley 75 and is secured to arm 56, as best illustrated in FIGS. 2 and 3. Pulley 75 does not rotate. Alternatively, pulley 75 may be a rotating pulley, and the cable 48 may extend over the pulley and down over another pulley on the frame to extend to other exercise stations. Rest member 72 projects upwardly from base 22 below lever arm 56, and has a rubber bumper 74 at its upper end to provide a rest for lever arm 56 when the press arm station is not in use, as illustrated in FIG. 1.

The yoke is preferably a split yoke made in two halves, each half comprising one of the side legs 54 and half of central portion 52. Each half of yoke 50 has a bracket or end plate 76 at the end of the central portion half. End plate 76 is suitably bolted or otherwise secured to lever arm 56 at a location intermediate the ends of arm 56 and in alignment with the other half of the yoke, as best seen in FIGS. 2 and 4.

Figure 1:
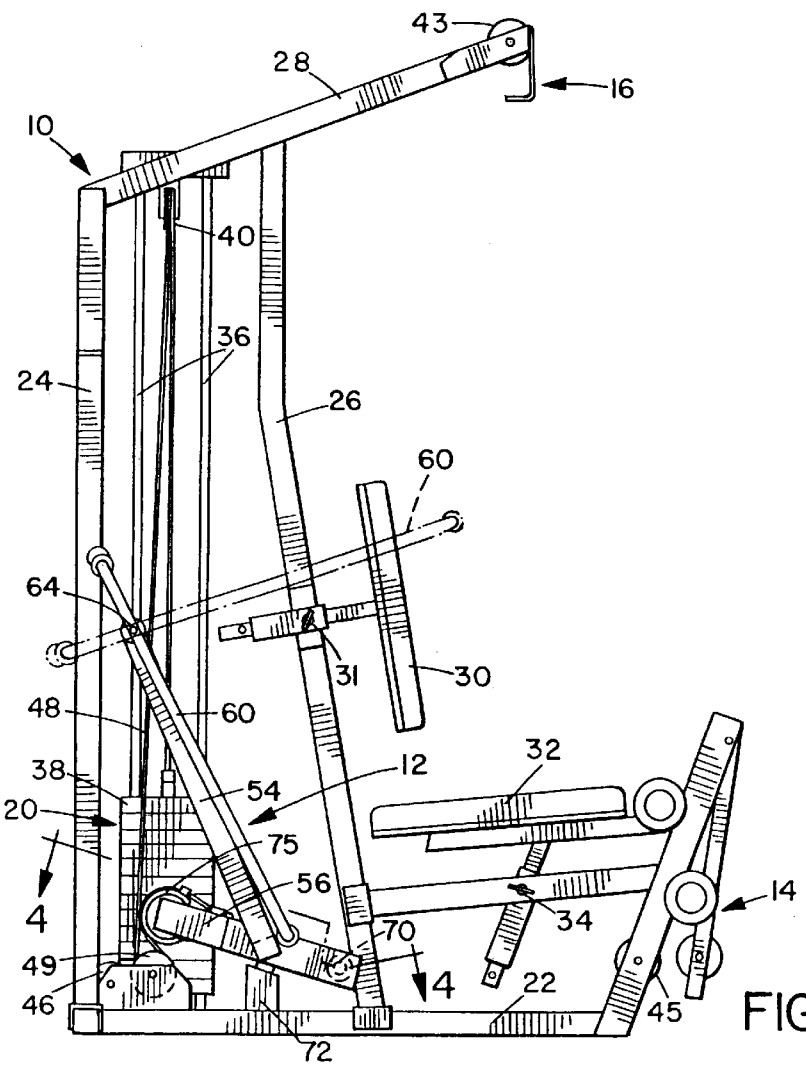
FIG. 1 is a side elevation view of an exercise machine incorporating the press arm assembly according to a first embodiment of the invention.

With this arrangement, the handle arms 60 can be freely rotated from the rest position of FIG. 1 about pivot pins 64 to any desired orientation, for example as illustrated in dotted outline in FIGS. 1 and 2. Various types of exercises can then be performed by the user pushing or pulling the handles so as to urge the yoke to rotate about pivot shaft 70 against the load on press arm cable 48. Thus, for example, handle arms 60 may be swung 10 up from the rest position illustrated in dotted outline to the substantially horizontal position illustrated in solid lines in FIG. 3. A user can then perform a vertical bench press type exercise by gripping hand grips or handles 69 and pushing away from seat back 30, in the direction of arrow 80. This acts to pull the yoke 50 forwardly and pivot the lever arm 56 about pivot shaft 70, in the direction of the arrow 82 in FIG. 3, simultaneously pulling on cable 48 and thus lifting the weight stack 20 upwardly as indicated in FIG. 3. The user can adjust the position of handles 69 simply by rotating about pivot pin 64, so that they are at just below shoulder height to perform this exercise, and the same exercise can therefore be performed easily by different height individuals when sitting on seat 32 with their back against back rest 30. This will exercise the chest, shoulder and tricep muscles.

Figure 6:
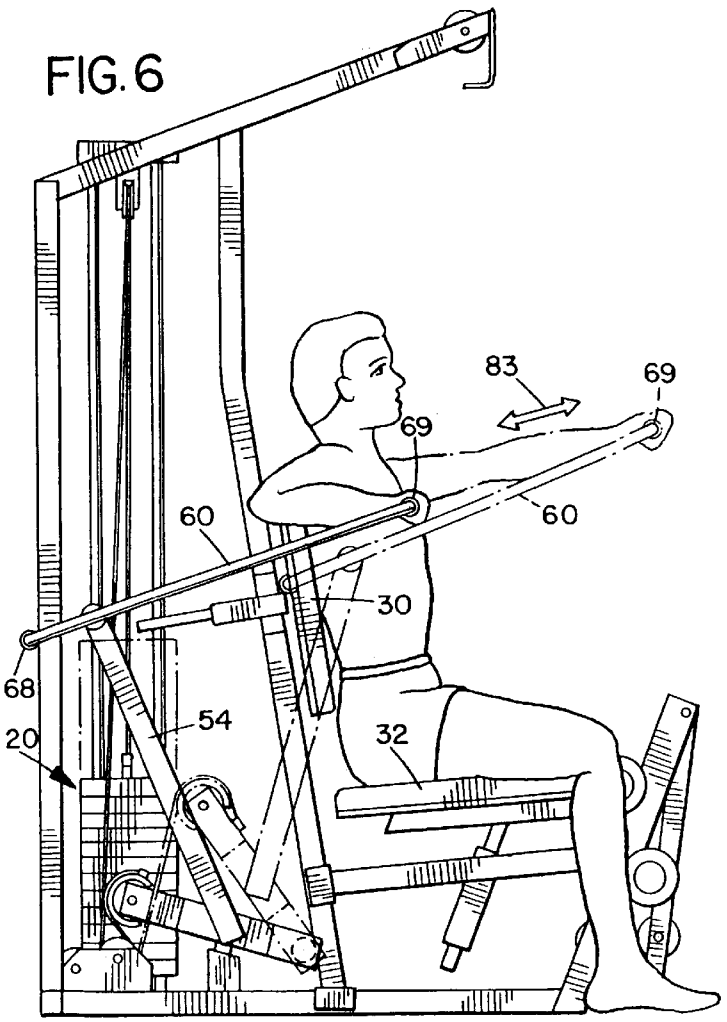
FIG. 6 is a side elevation view of the machine showing one type of exercise using the press arm assembly.

A decline press exercise can be performed by a user in the same position by pressing the handles forward and down. This exercises the lower chest and triceps. Similarly, an incline press exercise can be performed in the identical position by pressing the handles forwardly and upwardly, in the direction of arrow 83 as illustrated in FIG. 6, exercising the upper chest and front of the shoulders. An abdominal crunch exercise can also be performed by a user in the sitting position of FIG. 6 raising the handles 69 to a position above the shoulders and just in front of the neck, and then curling their body forward towards their knees, again rotating the yoke and lever arm about pivot 70 and pulling the cable 48 and attached weight stack elements. This motion will exercise the abdominal muscles.

Figure 7:
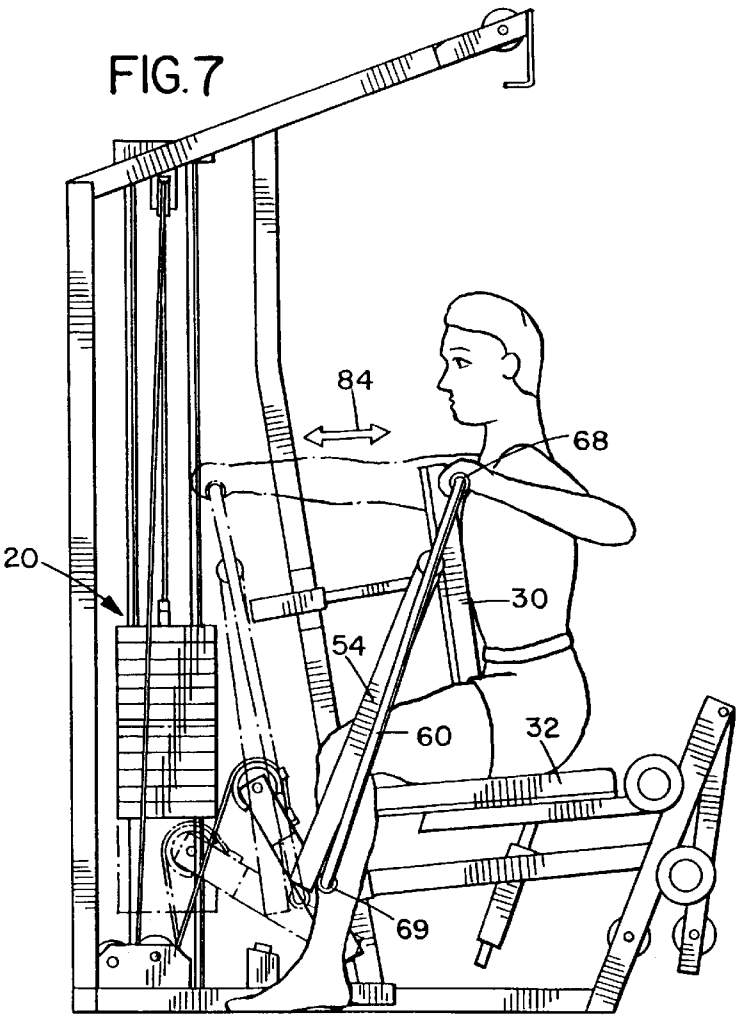
FIG. 7 is a similar view showing another type of exercise.

Another type of exercise may be performed using the short handles 68 with the user seated astride seat pad 32 in a rearward facing position facing the back of the machine and with their chest against back pad 30, as illustrated in FIG. 7. The handle arms are rotated into the rest position in which short handles 68 are uppermost with the in-turned handles 69 at the opposite end of each handle arm bearing against the central portion 52 of the yoke, as best illustrated in FIG. 2. The user then pulls the handles 68 alternately towards and away from their body, as indicated by arrow 84 in FIG. 7. Since the arms cannot rotate due to handles 69 bearing against yoke 50, this has the effect of pulling the yoke and attached lever arm upwardly and forwardly, rotating around pivot shaft 70 as illustrated in FIG. 7. This also pulls on cable 40 and raises the attached weight stack elements. This procedure will exercise the lateral, trapezius and bicep muscles.

Figure 8:
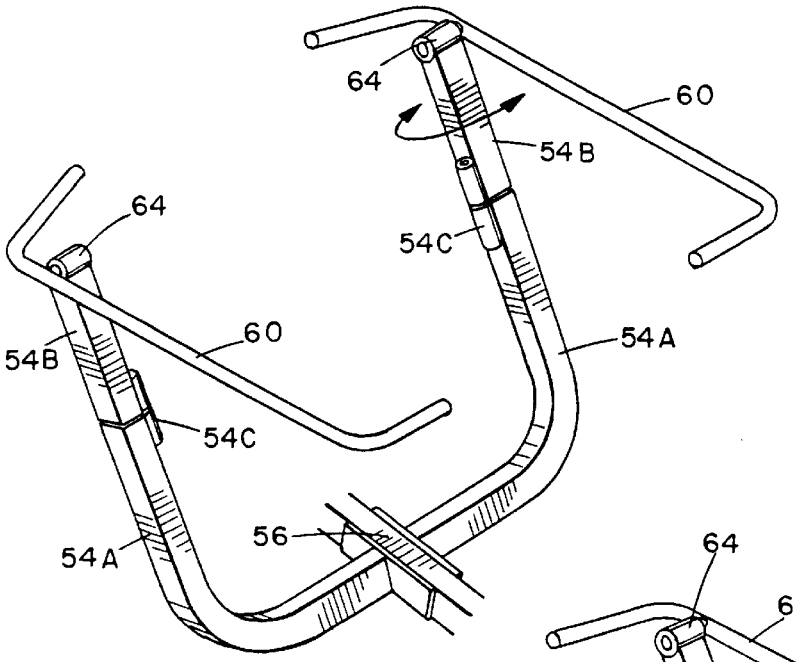
FIG. 8 is a perspective view of part of a modified press arm assembly for the exercise machine of FIG. 1.
Figure 9:
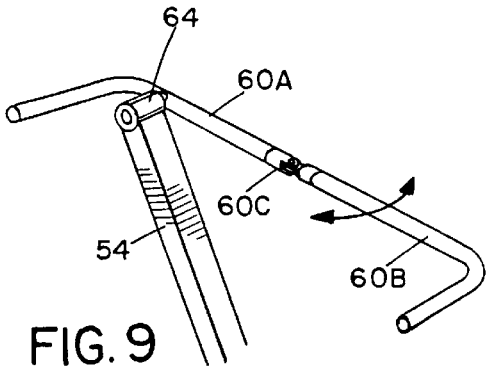
FIG. 9 is a partial view similar to FIG. 8 of one arm of a press arm assembly illustrating another modification.
Figure 10:
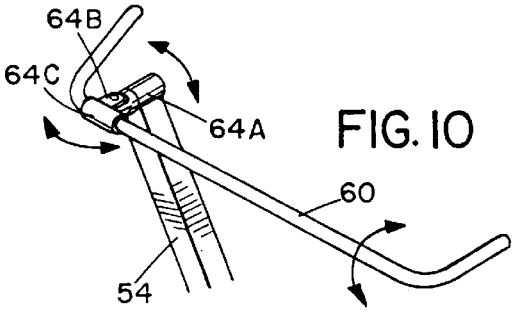
FIG. 10 is a view similar to FIG. 9 illustrating part of the arm of another modified press arm assembly.

FIGS. 8–10 illustrate three alternative arrangements in which the handle arms 60 can be rotated out and in as well as up and down, to provide greater versatility in positioning the handles for a desired exercise. In each case, the remainder of the press arm assembly will be identical to that of the first embodiment, and like reference numerals have been used for like parts as appropriate.

In the embodiment of FIG. 8, the side portions or legs 54 of yoke 50 are each split into two separate portions, an inner portion 54A integral with the central portion of the yoke, and an outer end portion 54B. The portions 54A and 54B on each side of the yoke are secured together via hinge or pivot pin 54C so that the outer end portion 54B can rotate about the axis of the respective leg in the direction of the arrow in FIG. 8. This permits the handle arms 60 to move in an outward to inward motion during exercise, in addition to rotating up and down about pivot or hinge 64.

FIG. 9 illustrates an alternative arrangement in which each handle arm is split into two portions 60A and 60B joined together at elbow joint or pivot 60C to permit inward and outward motion of the handle arm portion 60B in the direction of the arrow in FIG. 9. Again, this will allow handle portion 60B to move in an outward to inward motion during exercise.

FIG. 10 illustrates another alternative arrangement for permitting outward to inward motion as well as up and down motion of the handle arms and swivelling of the handle arm 60 about its own axis to vary the handle orientation. In this alternative, single pivot pin 64 is replaced with a first pivot pin 64A for permitting rotation about a first axis and a second pivot pin 64B perpendicular to the first pin for permitting rotation about a second, perpendicular axis. Pivot pin 64A is rotatably mounted in a sleeve at the end of yoke leg 54. Pivot pin 64B is secured to a sleeve 64C in which handle arm 60 is rotatably mounted, and extends through a transverse bore in pin 64A to provide an articulating joint. This permits the user to rotate arm 60 in sleeve 64C to adjust the handle orientation, and also to pivot the arm up and down about the axis of pin 64A, as well as out and in about the axis of pin 64B, essentially allowing the user to move the arm in all directions. This provides a three-dimensional pivot joint at one location, where the swing arm is linked to the yoke. By providing pivoting and rotation at the same point, the press arm can emulate the way the body moves more closely. This makes exercising more comfortable and natural feeling.

In each of the above three embodiments, the user has greater freedom of movement than in the first embodiment since they are able to move the handles outwardly and inwardly, and can move the handles up and down in any of the adjusted positions.

Figure 12:
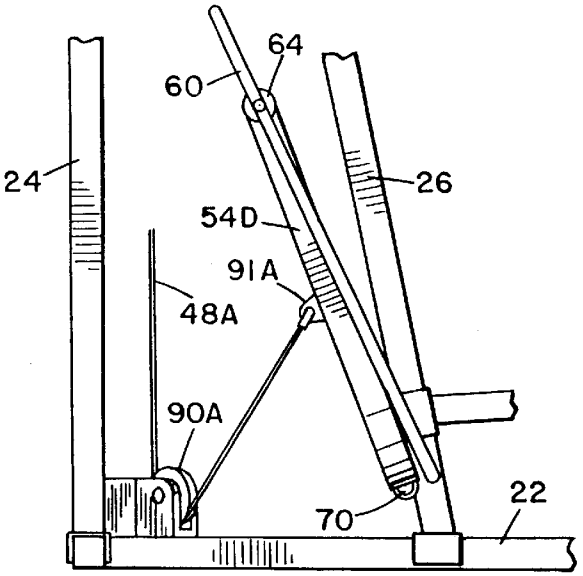
FIG. 12 is a side elevation view of the press arm assembly of FIG. 11.
Figure 11:
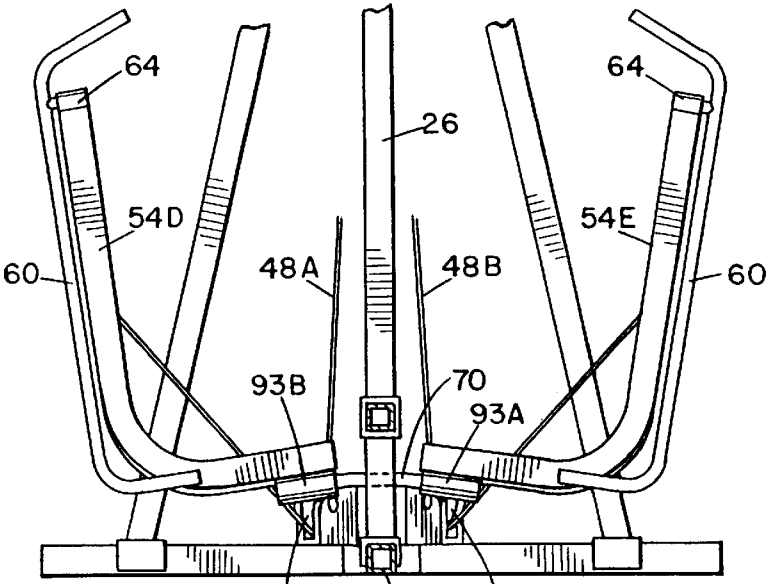
FIG. 11 is a front view of a press arm assembly according to another embodiment of the invention.

In each of the above embodiments, a lever arm 56 is used to transmit load via yoke 54 to the handle arms. FIGS. 11 and 12 illustrate an alternative embodiment in which yoke 54 is replaced with two separate, independently movable yoke arms 54D and 54E. In this alternative, load is transmitted directly to the yoke arms 54D and 54E and the lever arm 56 is eliminated. In this alternative, instead of tying one end of cable 48 to floating single pulley 47 as in the first embodiment, the pulley 47 is replaced with a double pulley and cable 48 extends over the lowermost pulley to provide two end portions 48A and 48B which are secured to the left-hand yoke arm 54D and the right-hand yoke arm 54E, respectively. Cable end portion 48A extends downwardly from the floating double pulley (not illustrated) and around fixed, outwardly directed pulley 90A, and then outwardly to the yoke arm 54D. The end of cable portion 48A is tied to an eyelet 91A secured to a central portion of the yoke arm 54D. Similarly, cable portion 48B extends downwardly around a second fixed, outwardly directed pulley 90B and is tied to an eyelet (not visible in the drawings) identical to eyelet 91A and secured to an equivalent, central portion of yoke arm 54E.

An angled pivot shaft 70 is secured across strut 26. A sleeve 93A secured to the end of yoke arm 54E is pivotally mounted on one end of pivot shaft 70, as illustrated in FIG. 11. Similarly, a sleeve 93B is secured to the inner end of yoke arm 54D and is pivotally mounted on the opposite end of pivot shaft 70. The angling of the opposite ends of pivot shaft 70 acts to angle the yoke arms outwardly, as illustrated in FIG. 11. As in the first embodiment, handle arms 60 are pivoted to the ends of the respective yoke arms via pivots 64. This arrangement permits the handle or pressing arms 60 to pivot in an outward to inward fashion.

The exercise machine of FIGS. 11 and 12 is otherwise identical to that of the first embodiment, and like reference numerals have been used for like parts as appropriate. Elimination of lever arm 56 simplifies the construction, while the same versatility of exercise movements is provided. The angling of the yoke arms allows outward to inward movement of the handle arms. In press arm type exercises, a movement from a wide starting position to a narrow finish position is believed to be most effective in exercising the muscles, since it provides more muscle closure. The bent pivot shaft of this embodiment permits this type of motion in a simplified fashion.

Figure 14:
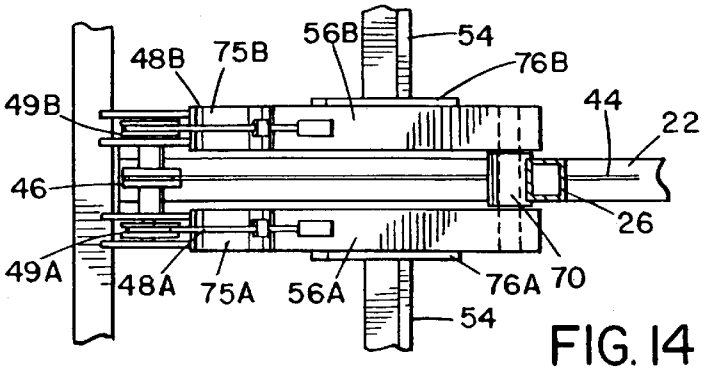
FIG. 14 is a top plan view, partially in section, of the assembly of FIG. 13.
Figure 13:
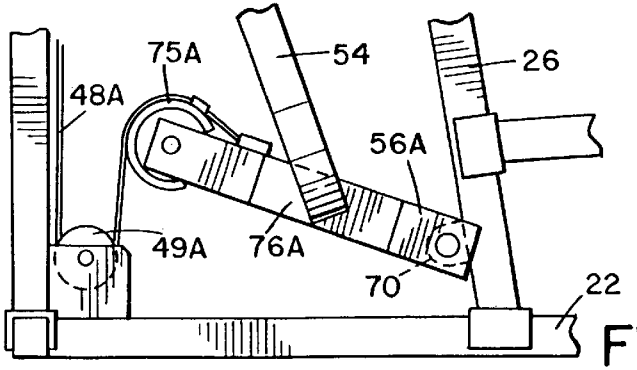
FIG. 13 is a partial side elevation view of another modified press arm assembly.

FIGS. 13 and 14 illustrate another modified embodiment of the invention in which the single lever arm 56 is replaced with separate lever arms 56A and 56B, one for each handle arm 60, to provide separate resistance to motion on each arm. Each lever arm 56A and 56B is independently pivoted at one end to opposite ends of pivot shaft 70, as best illustrated in FIG. 14. A pulley or cam wheel 75A,75B, is secured to the opposite end of each lever arm 56A,56B, respectively. As in the previous embodiment, the cable 48 is split into two end portions 48A and 48B. One end portion 48A extends downwardly over pulley 49A mounted on the base frame and is then secured over cam wheel 75A to the lever arm 56A. Similarly, the other end portion 48B of the cable extends over a pulley 49B and is then secured to the lever arm 56B over cam wheel 75B. The yoke ends 54 are secured to an intermediate point on each of the lever arms via mounting plates 76A and 76B, respectively. The machine of FIGS. 13 and 14 is otherwise identical to the first embodiment, and like reference numerals have been used for like parts as appropriate.

With this arrangement, each handle or pressing arm has its own lever arm and cable attachment, and both lever arms pivot on the same pivot axis for independent resistance.

Figure 15:
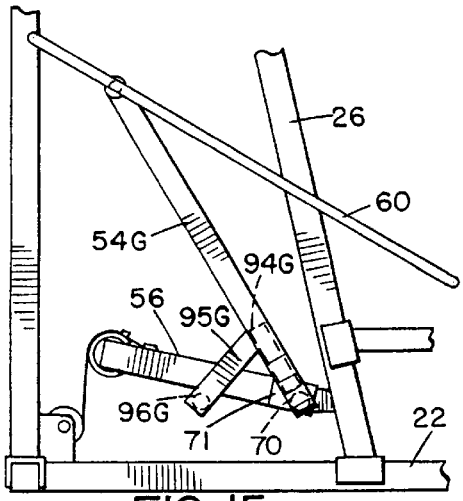
FIG. 15 is a side elevation view of a further modified press arm assembly.
Figure 16:
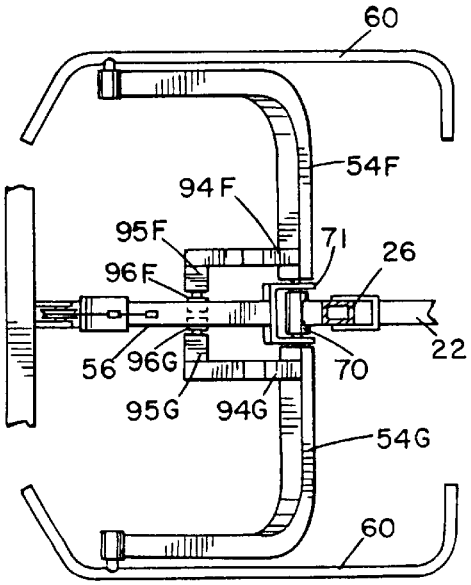
FIG. 16 is a top plan view of the assembly of FIG. 15.

FIGS. 15 and 16 illustrate another alternative arrangement. In this arrangement, instead of rigidly securing the yoke legs to the lever arm, the yoke is split into separate yoke halves 54F and 54G, each of which is pivotally mounted on the support frame via pivot axle 70. Alternatively, the two yoke halves may be mounted on a different pivot axis to arm 56. A link arm 94F,94G projects from each yoke half at a location adjacent lever arm 56. Each link arm has an inwardly and downwardly projecting end portion 95F,95G respectively, carrying a roller 96F,96G projecting beneath the lever arm, so that the lever arm is lifted via either or both yoke halves to provide resistance.

Figure 17:
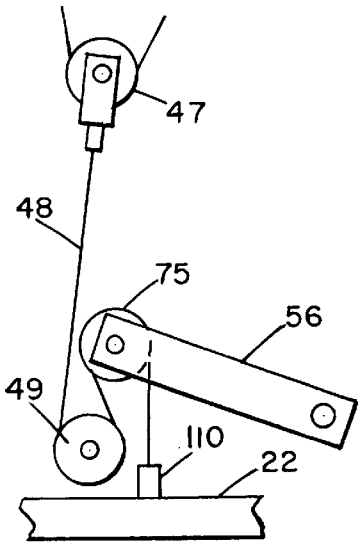
FIG. 17 is similar to a portion of FIG. 5, showing an alternative cable arrangement.
Figure 18:
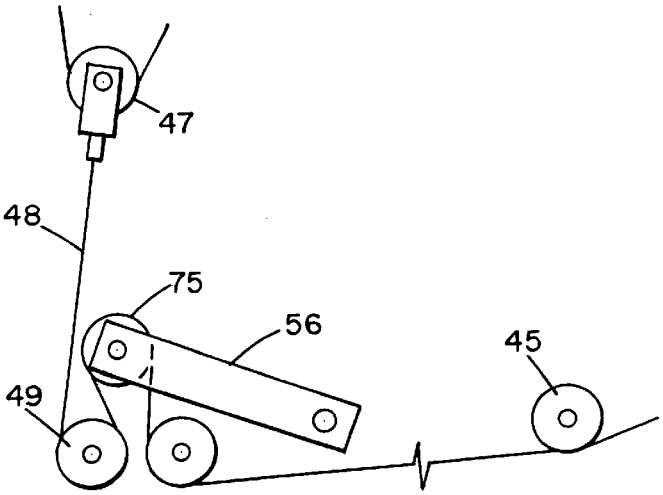
FIG. 18 is similar to FIG. 17, showing a further cable arrangement.
Figure 19:
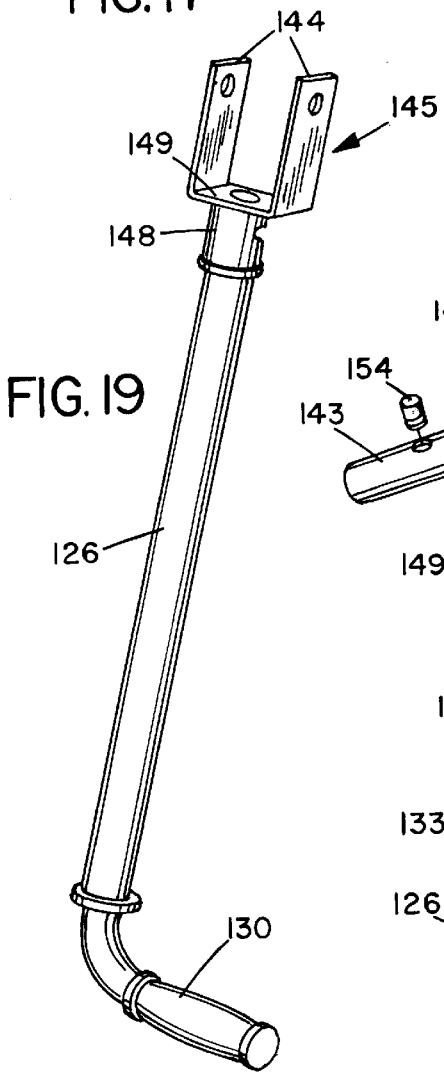
FIG. 19 is a perspective view of an alternative handle configuration for use in a press arm assembly according to another embodiment of the invention.

In the previous embodiments, the cable 48 linking the weight stack to the lever arm or yoke is shown to terminate at the pulley 75 at the end of the lever arm. However, in any of the preceding embodiments, the cable may alternatively extend beyond pulley 75 and be tied to a suitable bracket or tie off 110 on the base 22 of the frame, as illustrated in FIG. 17. Alternatively, as illustrated in FIG. 18, cable 48 may extend beyond pulley 75 to another exercise station, for example around pulley 45 to a leg curl/extension exercise.

Figure 20:
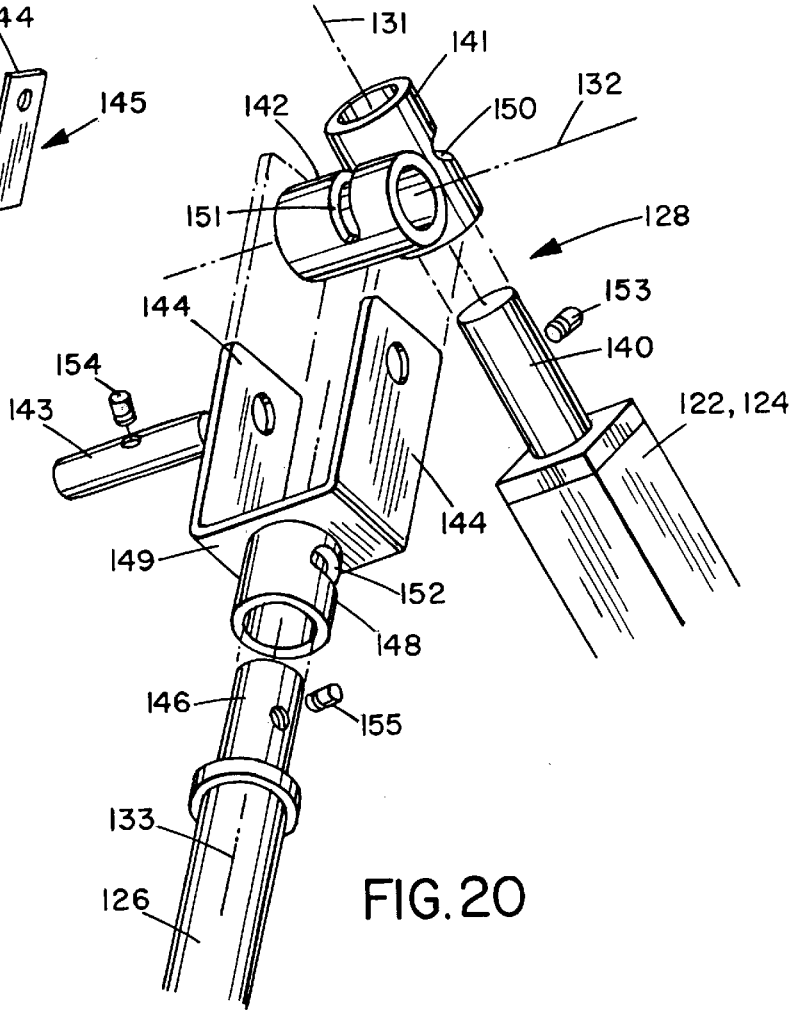
FIG. 20 is an enlarged, exploded view of a three axis pivotal joint for use with the handle of FIG. 19.
Figure 21:
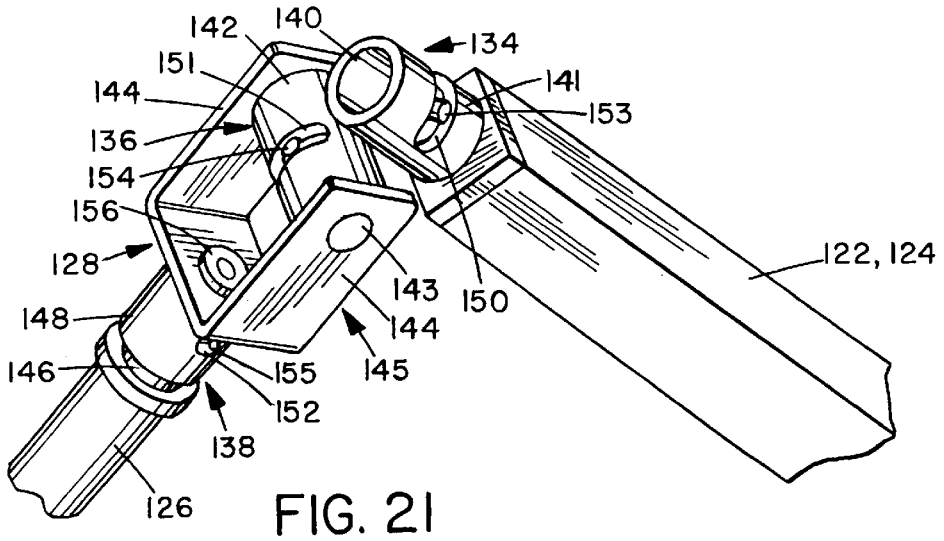
FIG. 21 is an assembled view of the components of FIG. 20.
Figure 22:
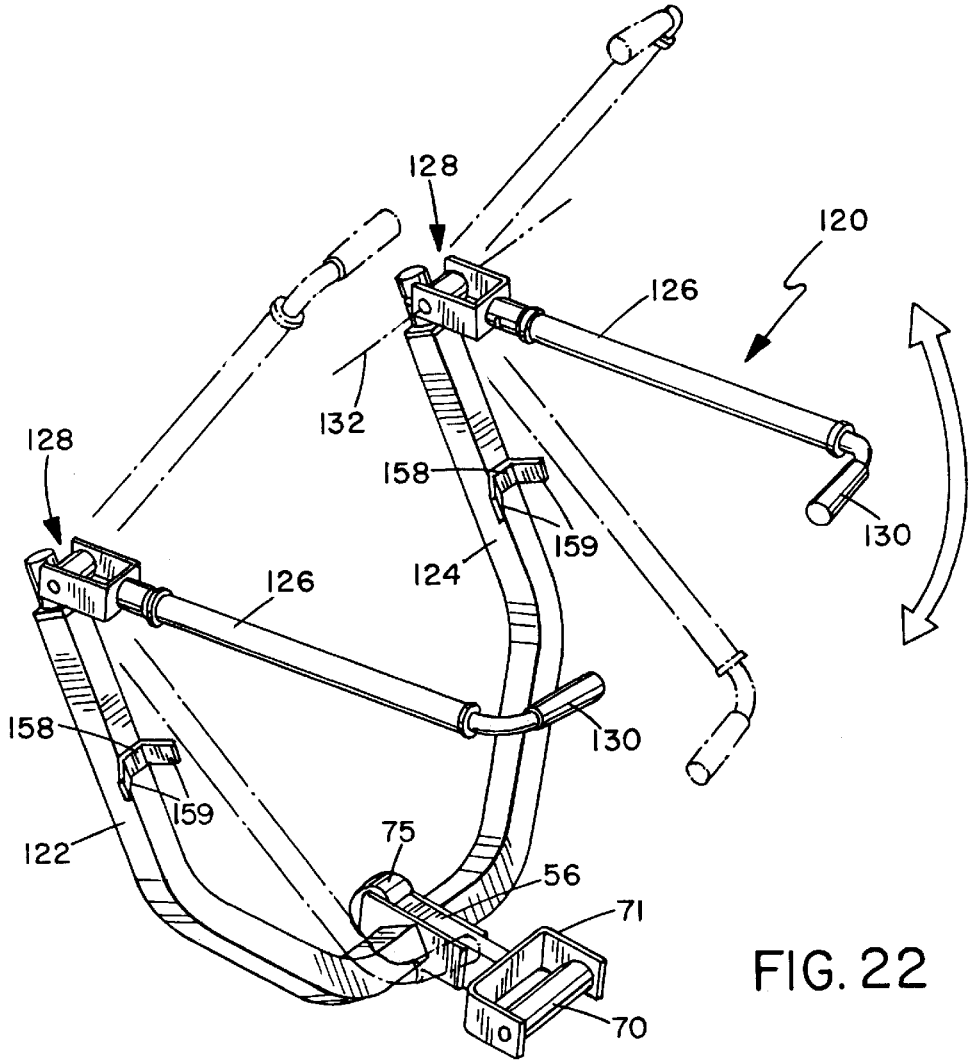
FIG. 22 is a perspective view of the entire press arm assembly incorporating the components of FIGS. 19–21, showing the vertical axis of motion of the handles.
Figure 23:
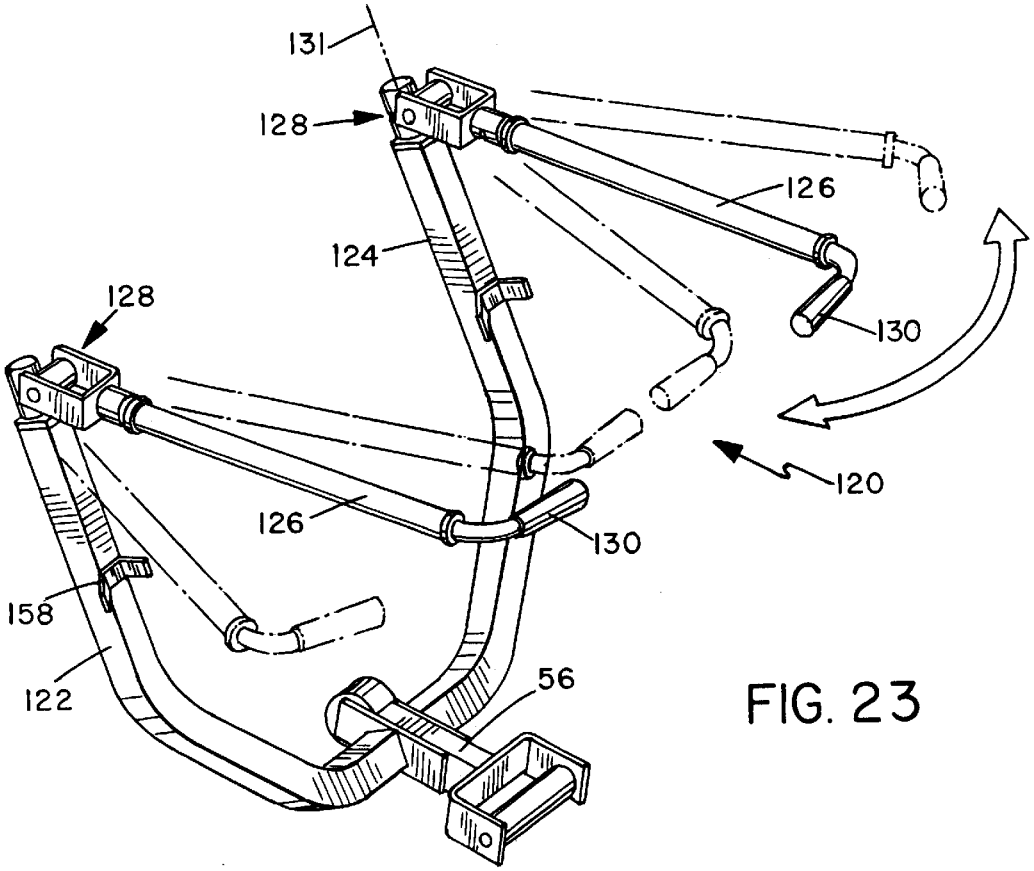
FIG. 23 is a similar view showing the horizontal axis of motion of the handles.
Figure 24:
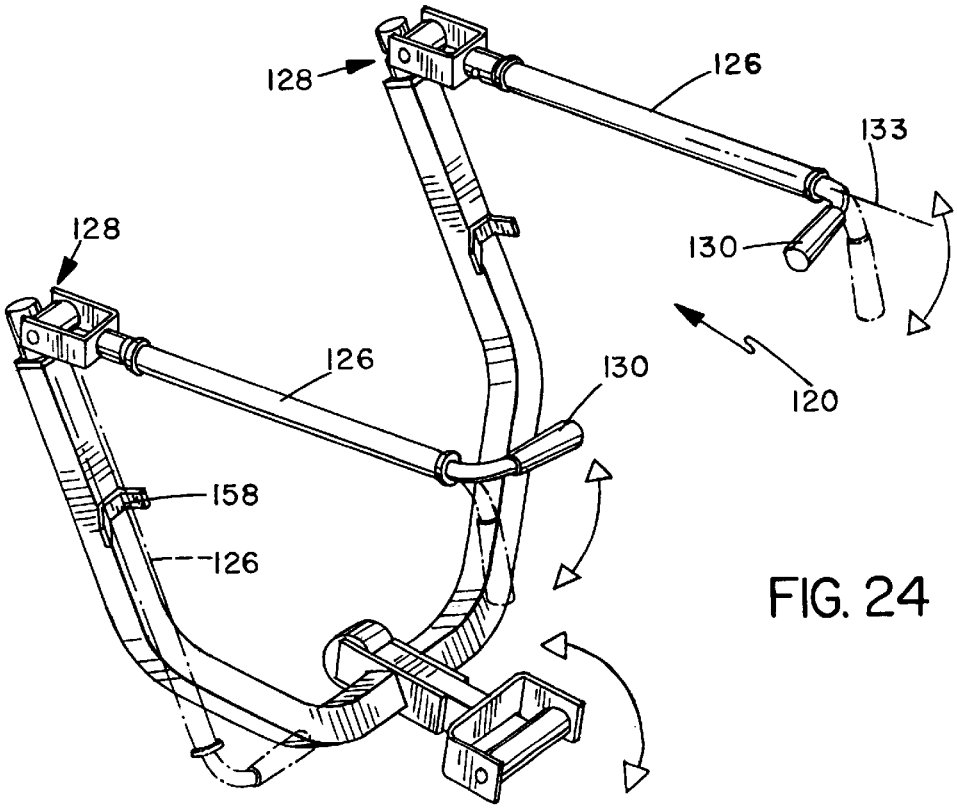
FIG. 24 is a similar view showing rotation of the hand grips and the direction of motion of the yoke.

FIGS. 19–24 illustrate a press arm assembly 120 according to another embodiment of the invention. Assembly 120 includes a lever arm 56 as in the previous embodiments, and like reference numerals have been used for like parts of arm 56 as appropriate. As in the previous embodiments, a generally U-shaped, split yoke has opposite side portions 122,124 secured to opposite sides of the lever arm 56, as best illustrated in FIGS. 22–24. Left- and right-hand swing arms 126 are each connected to the end of a respective yoke side portion 122,124 via a three-dimensional pivot joint or assembly 128 allowing pivoting or rotation about three perpendicular axes. Each swing arm has a handle 130 at its free end for gripping by a user when performing exercises.

Each three-dimensional pivot assembly 128 allows the arms to pivot or rotate relative to the respective yoke side portion about three perpendicular axes 131,132,133, as illustrated in FIG. 20. The first axis 131 is coaxial with the respective yoke side portion 122,124, the second axis 132 is transverse to both the yoke side portion and the swing arm and the third axis 133 is coaxial with the swing arm 130. The assembly 128 includes a first pivot joint 134 for rotation of swing arm 126 about the first pivot axis 131 to provide a generally in and out motion of the swing arm, as indicated in FIG. 23. A second pivot joint 136 provides rotation about axis 132 in a generally up and down direction, as indicated in FIG. 22, while a third pivot joint 138 provides rotation of the arm 126 about its own axis 133 so as to vary the orientation of handle 130, as best illustrated in FIG. 24. At the same time, the entire swing arm assembly 120 is rotatable about the axis of pivot pin 70 for performing various exercises.

Each yoke side portion 122,124 has a projecting pin or shaft 140 on which a sleeve 141 is rotatably mounted to provide the first pivot joint 134. A second sleeve 142 is welded transverse to sleeve 141 and is rotatably mounted on a pivot pin 143 extending between the opposite arms 144 of a U-shaped bracket 145, providing the second pivot joint 136. A pin or shaft 146 projecting from the end of each swing arm 130, and a sleeve 148 projecting from the base 149 of bracket 145 is rotatably mounted over shaft 146 to form the third pivot joint 138. Each of the three sleeves 141,142 and 148 preferably has a rotation limiting slot 150,151,152, respectively, extending around part of its periphery, as best illustrated in FIGS. 20 and 21. A suitable stop pin or bolt 153 projects through slot 150 from shaft 140 to limit rotation of the sleeve 141 on shaft 140. A similar stop pin or bolt 154 projects from pivot pin 143 through slot 151 to limit rotation of sleeve 142 on pin 143. Finally, stop pin or bolt 155 projects from shaft 146 through slot 152 to limit rotation of arm 126.

The three-dimensional pivot assembly allows the user to pivot each swing arm up and down about axis 132 as indicated in FIG. 22, and in and out about axis 131 as indicated in FIG. 23. The user can also readily adjust the orientation of handles 130 by rotating them about arm axes 133, as illustrated in FIG. 24. Once the desired orientation of the swing arms 126 and handles 130 is achieved, the user can push and pull on the handles so as to rotate the yoke and lever arm 56 about the axis of pin 70 against the selected resistance. The handle orientation may be changed during each swing as needed. The rotation limiting slots reduce the rotation of handles 130 to reduce the risk of wrist injury, and reduce the in and out motion so that the arms cannot be swung too far out to a position which may pose a hazard to others in the vicinity, or swung too far in to a position which may pose a risk to the user. Although a rotation limiting slot is also provided in the up and down pivot joint 136 in the illustrated embodiment, this is not as critical as the other two rotation limiters. The range of motion permitted by each rotation limiting slot is preferably of the order of 60° to 90°.

The end of shaft 146 on each swing arm is preferably rotatably secured in the base 149 of the respective U-bracket 145 by means of a thrust bearing 156, as best illustrated in FIG. 21. This thrust bearing allows the handle to rotate freely, even when under a load during both fly and pressing motions. Because of this the user's wrist can adjust and compensate for any change in the angle of the exercise motion. This results in a very natural and comfortable feeling for the user during pressing motions, which truly duplicates the feel of free weights, long considered the most ideal form of resistance training.

A self-centering press arm seat or cradle 158 is mounted on each of the yoke side portions 122,124, as best illustrated in FIGS. 22–24. Each cradle 158 is generally V-shaped with a base portion secured to the respective yoke side portion 122,124 and a pair of outwardly inclined arms 159 for guiding the respective swing arm into a rest position in the cradle, as illustrated in dotted outline in FIG. 22. The rotation limiting slot 150 on sleeve 141 is preferably arranged such that the respective handle arms cannot rotate out or in beyond the range of cradle 158, so that whatever position the handle or swing arms are in when they are released, they will automatically drop down into the respective cradle. When the swing arm is in the outermost position permitted by slot 150 (i.e. pin 153 reaches an outer end of the slot), the arm will be aligned with the outer edge of the cradle. If the handle is released in this position, it will be automatically centered due to the V-shape of the cradle. The cradles 158 are also arranged to keep the handles in a raised position, so that they can be readily grasped by a user when ready to use the apparatus.

The limiter 151 for up/down movement around axis 132 is used to prevent someone from pressing the arms straight up and potentially impacting another exercise station directly overhead, or pressing straight down and potentially impacting the base of the frame with his or her hands. The limiter 152 for rotating the handle about the handle arm axis prevents the handle from turning too far and causing possible wrist injury, yet permits the user to go from press exercises (handle horizontal) to fly exercises (handle vertical) easily, and also permits the user to find the natural, most comfortable position for their wrist during any exercise.

There is an advantage to rotating the entire handle arm about its axis, as in this arrangement, rather than rotating only the handle or hand grip as in numerous prior arrangements. This is because rotation of the entire handle arm follows the natural rotation of a user's arm more accurately. In order to turn the wrist, the forearm rotates at the elbow. The wrist is not designed to rotate on its own. If the handle or grip only is rotated, the arm/wrist is forced to go through a slight arcing motion. This is avoided by making the entire handle arm rotate.

The three-dimensional joint or pivot assembly of this invention provides all the motions at substantially the same point, where the respective swing arm connects to the yoke side portion. This emulates the way the user's body moves more closely than prior art arrangements. In/out and rotational movements are controlled by the user's elbow, while up and down motion is controlled by the shoulder which lines up in the same plane as the elbow. Thus, the three-dimensional pivot assembly allows these motions to be carried out more comfortably and naturally than cases where the different pivots are spaced apart.

The user therefore pivots the handle or press arms up and down to select the desired exercise angle. The press arms are also pivoted in and out to choose either a traditional straight pressing motion or an arcing pressing motion. The press arms are then rotated about their axes to let the user choose between a pressing motion, in which the handles will be more or less horizontal, and a fly motion, where the handles are substantially vertical. The rotating handle arms also self align to help the user find the most natural wrist position.

The press station is therefore extremely versatile, and allows the user to freely position the handle to accommodate different height individuals, and, once positioned, to push the handle in any direction to exercise different muscle regions. The low hinge pressing assembly, with independent, circulating arms, allows different exercises to be performed simply by changing the angle of exercise motion. By providing handles at opposite ends of each handle arm and pivoting the arm to the yoke between the handles, the same handle arm can be used both for press exercises and mid-row exercises, simply by reversing the handles. In the past, separate handle arms have been provided for rear-facing, mid-row exercises.

The other three exercise stations linked to the weight stack are of a conventional nature and will therefore not be described in detail.

Although some preferred embodiments of the invention have been described above by way of example only, it will be understood by those skilled in the field that modifications may be made to the disclosed embodiments without departing from the scope of the invention, which is defined by the appended claims.

I claim:

1. An exercise apparatus, comprising:

a support frame having an upper portion, a base portion, a forward end, a rear end, and opposite sides;

a yoke assembly pivotally linked to the support frame for swinging movement about a first pivot axis, the yoke assembly having first and second side portions, each yoke side portion having a longitudinal axis;

biasing means linked to said yoke for resisting movement of said yoke about said first pivot axis;

first and second elongate swing arms each having a longitudinal axis and being linked to said first and second side portions of said yoke assembly, respectively, each swing arm having at least one handle at one end for selective gripping by a user to perform different exercises;

first and second pivot assemblies linking the first and second swing arms, respectively, to the respective first and second yoke side portions, each pivot assembly having a first pivot connection for allowing movement of said respective arm in a circular path about a first adjustment axis, a second pivot connection for allowing movement of said arm about a second adjustment axis perpendicular to the first axis, and a third pivot connection for allowing rotation of said swing arm about a third adjustment axis perpendicular with the first and second adjustment axes and aligned with the longitudinal axis of said swing arm to adjust the orientation of said handle;

the third pivot connection comprising a first sleeve, the swing arm being rotatably mounted directly in said sleeve; and a bracket connecting the second pivot connection to said sleeve, whereby the second adjustment axis is offset from said swing arm.

2. The apparatus as claimed in claim 1, wherein at least two of said pivot connections include limit means for limiting rotation of said swing arm about said respective adjustment axes to a predetermined angular range.

3. The apparatus as claimed in claim 2, wherein at least said first and third pivot connections include limit means.

4. The apparatus as claimed in claim 2, wherein all of said pivot connections include limit means.

5. The apparatus as claimed in claim 2, wherein the predetermined angular range is 60° to 90°.

6. The apparatus as claimed in claim 1, wherein said yoke is U-shaped and has opposite free ends, said swing arms being pivotally secured to the opposite free ends of said U-shaped yoke.

7. The apparatus as claimed in claim 1, including pivot means pivotally linking said yoke assembly to the support frame, said pivot means comprising a lever arm having a first end pivotally secured to said support frame and defining said first pivot axis, a second end linked to said biasing means, said lever arm being connected to the yoke assembly at a location between said first and second ends.

8. The apparatus as claimed in claim 7, wherein said support frame comprises a base, an upright member projecting upwardly from said base, and an upper member at the top of said upright member, and said first pivot axis and second axis are parallel, horizontal axes.

9. The apparatus as claimed in claim 8, wherein said yoke side portions define a first plane and said pivot means comprises a lever arm secured to the yoke side portions to extend at an angle to said first plane, said lever arm having a first end pivotally secured to said support frame to define said first pivot axis and a second end linked to said biassing means.

10. The apparatus as claimed in claim 9, wherein said lever arm is pivotally secured to said upright member adjacent the base of said frame and said lever arm extends rearwardly from said upright member.

11. The apparatus as claimed in claim 9, wherein said biassing means comprises a weight stack slidably mounted on said frame and a cable and pulley linkage linking said weight stack to said lever arm.

12. The apparatus as claimed in claim 11, wherein said cable extends beyond said lever arm to a further exercise station.

13. An exercise apparatus, comprising:

a support frame having an upper portion, a base portion, a forward end, a rear end, and opposite sides;

a yoke assembly pivotally linked to the support frame for swinging movement about a first pivot axis, the yoke assembly having first and second side portions, each side portion having a longitudinal axis;

biasing means linked to said yoke for resisting movement of said yoke about said first pivot axis;

first and second elongate swing arms each having a longitudinal axis and being linked to said first and second side portions of said yoke assembly, respectively, each swing arm having at least one handle at one end for selective gripping by a user to perform different exercises;

first and second pivot assemblies linking the first and second swing arms, respectively, to the respective first and second yoke side portions, each pivot assembly having a first pivot connection for allowing movement of said respective arm in a circular path about a first axis aligned with the longitudinal axis of the respective yoke side portion, and a second pivot connection for allowing movement of said arm about a second axis perpendicular to the first axis;

each swing arm having a rotatable coupling for allowing rotation of said handle about the longitudinal axis of said swing arm to adjust the orientation of said handle;

each pivot assembly comprising a three-dimensional pivot assembly, and each rotatable coupling comprising a third pivot connection of said pivot assembly for allowing rotation of said swing arm about said swing arm axis;

each of the three pivot connections comprising a pin and a sleeve rotatably mounted on the pin;

the first pivot connection comprising a first pin axially mounted at the outer end of the respective yoke side portion and a first sleeve rotatably mounted on the first pin, the second pivot connection comprising a second sleeve secured perpendicular to said first sleeve and a second pin rotatably mounted in said second sleeve, and the third pivot connection comprising a third sleeve secured transverse to said second pin and a third pin secured to the end of the respective swing arm; and at least the first and third sleeves each having an arcuate slot extending around part of its periphery, and a stop pin projecting from the first and third pins, respectively, through the respective arcuate slot, each slot and stop pin comprising limiter means for limiting the range of rotation of said swing arm about the respective pivot axis.

14. The apparatus as claimed in claim 13, including a cradle on each yoke side portion for seating the respective swing arm when not in use, each cradle having an outer edge and an inner edge aligned with the respective swing arm in a first angular position and a second angular position about said first pivot axis, the slot and the stop pin on said first sleeve defining a predetermined angular range of movement about said first pivot axis having a first end position corresponding to said first angular position on said cradle and a second end position corresponding to said second angular position on said cradle, the slot and stop pin and the cradle together comprising means for centering said swing arm if released in any position within said angular range, whereby said swing arms will automatically drop down into said cradles if released anywhere within said predetermined angular range.

* * * * *